United States Patent [19]

Honda et al.

[11] Patent Number: 4,495,267

[45] Date of Patent: Jan. 22, 1985

[54] MAGNETIC TONER HAVING IMPROVED HUMIDITY DEPENDENCY

[75] Inventors: Nobuyasu Honda, Tenri; Toshiro Yamakawa, Osaka; Toshimitsu Ikeda, Himeji, all of Japan

[73] Assignee: Mita Industrial Co., Ltd., Osaka, Japan

[21] Appl. No.: 477,660

[22] Filed: Mar. 22, 1983

[30] Foreign Application Priority Data

Mar. 26, 1982 [JP] Japan ..... 57-47462

[51] Int. Cl.[3] ..... G03G 9/08; G03G 9/14

[52] U.S. Cl. ..... 430/106.6; 430/903; 428/407; 252/62.54; 252/62.56

[58] Field of Search ..... 430/106.6, 137, 903; 252/62.54, 62.56; 428/407

[56] References Cited

U.S. PATENT DOCUMENTS 3,718,594 2/1973 Miller ..... 430/106.6 X 4,075,391 2/1978 Berg et al. ..... 252/62.56 X

FOREIGN PATENT DOCUMENTS 54-54640 5/1979 Japan ..... 430/106.6

*Primary Examiner*—Roland E. Martin

*Attorney, Agent, or Firm*—Sherman & Shalloway

[57] ABSTRACT

Disclosed is a magnetic toner having an improved humidity dependency, which comprises as main ingredients a magnetic material composed of magnetite and a binder medium, wherein the water-soluble component content in the magnetite is lower than 0.15% by weight and the water content of the magnetite at a temperature of 20° C. and a relative humidity of 60% is lower than 0.3% by weight.

If this magnetic toner is used for developing an electrostatically charged image, a sharp and clear copy having a high image density with no fogging can be obtained even under a high humidity condition.

7 Claims, 1 Drawing Figure

MAGNETIC TONER HAVING IMPROVED HUMIDITY DEPENDENCY

BACKGROUND OF THE INVENTION (1) Field of the Invention

The present invention relates to a magnetic toner for developing an electrostatically charged image. More particularly, the present invention relates to a magnetic toner for developing an electrostatically charged image, having an improved humidity dependency, which does not cause scattering or fogging even under a high humidity condition and which provides a sufficient image density with a high transfer efficiency.

(2) Description of the Prior Art

A so-called one-component type magnetic developer comprising a powder of a ferromagnetic material incorporated in developer particles is widely known and used as the developer capable of developing an electrostatically charged latent image without using a particular carrier.

When an electrostatic latent image is developed by the one-component type magnetic developer, individual developer particles simultaneously undergo an electrostatic attracting force (Coulomb force) of attracting the developer particles to the electrostatic latent image and a magnetic attracting force of attracting the developer particles to a magnet for forming a magnetic brush. The particles on which the Coulomb force imposed is larger than the magnetic force are attracted to the electrostatic latent image, while the particles on which the magnetic force imposed is larger than the Coulomb force are left on the developing sleeve, whereby development is effected according to the static latent image on a substrate.

The one-component type developer is divided into two types, that is, one type comprising a so-called electroconductive magnetic toner and a so-called insulating magnetic toner. These magnetic toners are ordinarily prepared according to the spray granulation method comprising dissolving or dispersing a magnetic material and a binder medium into a volatile solvent and spraying the solution or dispersion into drying air to effect granulation, or the pulverization method comprising comprising melt-kneading a magnetic material such as magnetite with a binder medium, cooling the melt and pulverizing the solidified mixture.

In these magnetic toners, a part of the magnetic material is exposed to the surface of the binder medium unless a resin having a high affinity with magnetite and being capable of forming magnetite into a film is used in case of the spray granulation method or unless a heat treatment is carried out after the pulverization in case of the pulverization method. Accordingly, if such special means is not adopted, these magnetic toners are readily influenced by water contained in air.

More specifically, in case of the electroconductive magnetic toner, under a high humidity condition, the toner particles are aggregated and are readily scattered, resulting in density unevenness such as fogging, and in case of the insulating magnetic toner, since the charging capacity of the toner per se is small and since the charge quantity is small and the charge retaining property is poor when the toner is charged, in a high-humidity atmosphere, the charge is readily lost by leaking and therefore, the density of the developed toner image is reduced, a sharp image can hardly be obtained and the transfer efficiency is reduced.

SUMMARY OF THE INVENTION

We found that in the case where magnetite is used as the magnetic material, if the water-soluble component content in the magnetite is controlled below a certain level, either an electromagnetic toner or an insulating magnetic toner in which the above-mentioned various defects are eliminated can be provided.

It is therefore a primary object of the present invention to provide a toner for developing an electrostatically charged image, which is hardly influenced by water in air, does not cause scattering or density unevenness such as fogging even under a high humidity condition and provides a transfer image having a high image density with a high transfer efficiency.

More specifically, in accordance with the present invention, there is provided a magnetic toner having an improved humidity dependency, which comprises as main ingredients a magnetic material composed of magnetite and a binder medium, wherein the water-soluble component content in the magnetite is lower than 0.15% by weight and the water content of the magnetite at a temperature of 20° C. and a relative humidity of 60% is lower than 0.3% by weight.

DETAILED DESCRIPTION OF THE INVENTION

Figure 1:
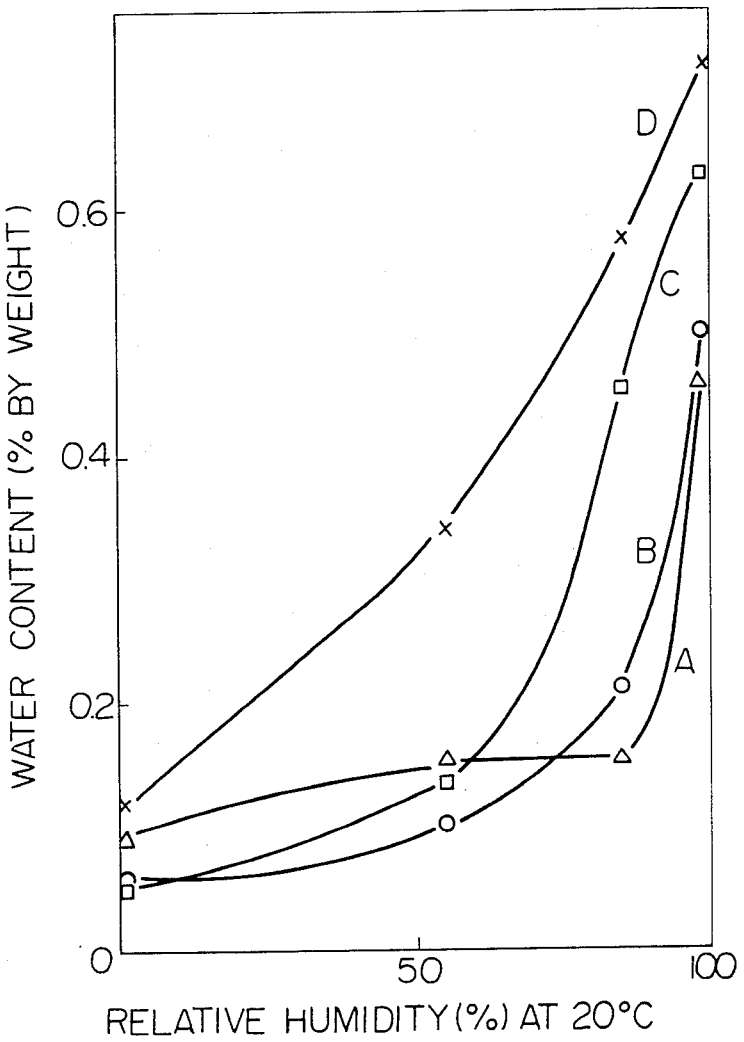
FIG. 1 is a graph illustrating the relation between the relative humidity (%) at 20° C. and the water-soluble component content (% by weight) in magnetite samples A, B, C and D.

Ordinarily, magnetite ($Fe_3O_4$) is prepared by burning and melting iron in an oxygen current or prepared from iron sulfate ($FeSO_4.7H_2O$) through hematite ($\alpha$-$Fe_2O_3$). In each case, a water-soluble component composed mainly of $SO_4$ is contained as an impurity. Since this water-soluble component is composed mainly of $SO_4$, the water-soluble component is hygroscopic and is very susceptible to the moisture. For example, as shown in the Referential Example given hereinafter, when curve D showing the change of the water content by the relative humidity in magnetite having a water-soluble content of 0.25% is compared with curve A showing the change of the water content by the relative humidity in magnetite having a water-soluble component content of 0.05% in FIG. 1 showing the relation between the relative humidity (%) at 20° C. and the water content (% by weight) in magnetite, it is seen that the water-soluble component content in magnetite has great influences on the humidity dependency of the toner. In magnetite customarily used as the magnetic material, the water-soluble component content is ordinarly about 0.20% by weight.

Accordingly, a magnetic toner comprising magnetite of this type as the magnetic material is likely to undergo influences of the humidity, and under a high humidity condition, the image density of the developed toner image is reduced or the toner particles scatter, and such troubles as fogging take place, a sharp image is hardly obtained and the transfer efficiency is reduced.

One of important features of the present invention is that magnetite having a water-soluble component content lower than 0.15% by weight is used as a fine powder of a magnetic material. More specifically, magnetite used in the present invention is characterized in that the water-soluble component content is controlled to a level much lower than the water-soluble component content of magnetite customarily used as a magnetic material. As is seen from the change of the water content by the humidity in samples A through C shown in Table 1 in the Referential Example given hereinafter, the magnetite used in the present invention is hardly susceptible to the influence of the humidity. Control of the water-soluble component content can easily be accomplished by performing water washing sufficiently by increasing the number of the water washing step when prepared magnetite is refined.

In the present invention, it is indispensable that the water content of the magnetite used in the present invention should be lower than 0.3% by weight at a temperature of 20° C. and a relative humidity of 60%.

When the water content is too high and exceeds the above-mentioned range, the above-mentioned various defects are brought about by the influence of water contained in the magnetite per se rather than by the influence of water contained in air.

In the present invention, it is preferred that the particle size of the magnetite used be in the range of from 0.05 to 10 μm, especially from 0.1 to 3 μm. If the particle size of the magnetite is too small and below the above-mentioned range, the number of magnetite particles exposed to the surface of the binder medium is increased, and the toner is readily influenced by the change of the humidity. If the particle size of the magnetite is too large and exceeds the above-mentioned range, formation of a homogeneous toner becomes difficult.

Resins, waxes and rubbers showing a binding property under application of heat or pressure can be used as the binder medium for dispersing magnetite. These binder media may be used singly or in the form of a mixture of two or more of them. Homopolymers or copolymers of mono- or di-ethylenically unsaturated monomers, especially (a) vinyl aromatic monomers or (b) acrylic monomers, may advantageously be used as the binder medium.

As the vinyl aromatic polymer, there are preferably used monomers represented by the following formula:

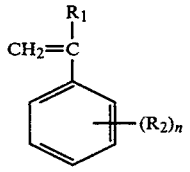

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of up to 2 inclusive of zero, such as styrene, vinyltoluene, α-methylstyrene, α-chlorostyrene and vinylxylene, and vinylnaphthalene. Among these monomers, styrene and vinyltoluene are especially preferred.

As the acrylic monomer, there can be mentioned acrylic monomers represented by the following formula:

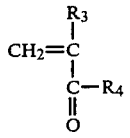

wherein $R_3$ stands for a hydrogen atom or a lower alkyl group, and $R_4$ stands for a hydroxyl group, an alkoxy group, a hydroxyalkoxy group, an amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-aminopropyl acrylate, 3-N,N-diethylaminopropyl acrylate and acrylamide.

As the other monomer to be used in combination with the monomer (a) or (b) or singly, there can be mentioned, for example, conjugated diolefin monomers represented by the following formula:

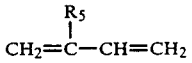

wherein $R_5$ stands for a hydrogen atom, a lower alkyl group or a chlorine atom, such as butadiene, isoprene and chloroprene, ethylenically unsaturated carboxylic acids such as maleic anhydride, fumaric acid, crotonic acid and itaconic acid, esters of these ethylenically unsaturated acids, vinyl esters such as vinyl acetate, vinylpyridine, vinylpyrrolidone, vinyl ethers, acrylonitrile, vinyl chloride and vinylidene chloride.

It is preferred that the molecular weight of a vinyl polymer as mentioned above be 3000 to 300,000, especially 5000 to 200,000.

If the magnetic toner of the present invention is used as an electroconductive magnetic toner, the abovementioned magnetite is melt-kneaded with the binder medium at a weight ratio of from 0.5/1 to 5/1, especially from 2/1 to 3/1, and an electroconductive substance such as carbon black is incorporated at this step in an amount of 0.1 to 10% by weight based on the sum of the magnetite and the binder medium. The resulting mixture is cooled, pulverized and classified to obtain a magnetic toner.

If the magnetic toner of the present invention is used as an insulating magnetic toner, the magnetite is mixed with the binder medium at a weight ratio of from 1/4 to 4/1, especially from 1/2 to 2/1 and melt-kneaded, and the mixture is cooled, pulverized and classified.

Instead of the above-mentioned melt-kneading, cooling and pulverizing method, there may be adopted a method in which the binder medium is dissolved in a polar organic solvent, for example, an aromatic solvent such as benzene, toluene, xylene or ethylbenzene, ketone such as acetone, methylethyl ketone or methylisobutyl ketone or an ether such as tetrahydrofuran or dioxane, the magnetite is dispersed in the solution and the dispersion is sprayed in drying air to effect granulation. If an electromagnetic toner is prepared according to this spray granulation method, an electroconductive substance such as carbon black is dispersed together with the magnetite or is dry-blended into the spray granulation product, whereby a desirable electric conductivity can be imparted to the obtained toner.

Also in the spray granulation method, the abovementioned mixing ratio of the magnetite to the binder medium is similarly adopted.

In the present invention, known auxiliary components for developers may be incorporated according to known recipes prior to the pulverization.

For example, in order to improve the hue of the developer, a pigment such as carbon black and/or a dye such as Acid Violet may be used in an amount of 0.5 to 5% by weight based on the total composition. Furthermore, in order to obtain a bulking effect, a filler such as calcium carbonate or finely divided silica may be incorporated in an amount of up to 20% by weight based on the total composition. If fixation of the developer is accomplished by using a hot roller, an offset-preventing agent such as silicon oil, a low-molecular-weight olefin resin or a wax may be incorporated in an amount of 2 to 15% by weight. If fixation of the developer is performed by using a pressure roll, a pressure fixability-imparting agent such as paraffin wax, an animal or vegetable wax or a fatty acid amide may be incorporated in an amount of 5 to 30% by weight of the total composition.

The molding of the magnetic toner is accomplished by cooling the above-mentioned kneaded composition, pulverizing the cooled composition and classifying the pulverized composition. Of course, mechanical rapid stirring may be effected for removing corners of indeterminate particles.

The particle size of the magnetic toner of the present invention is changed according to the mode of the use of the toner, but in view of the quality of the formed image or in order to prevent contamination of the surface of the photosensitive material, it is ordinarily preferred that the particle size of the magnetic toner be 5 to 50 microns.

If desired, a minute amount of a flow modifier such as dry method finely divided silica may be dry-blended in the magnetic toner of the present invention.

The present invention will now be described in detail with reference to the following Examples that by no means limit the scope of the invention.

Incidentally, in these Examples, the water-soluble component content of magnetite was determined according to the following procedures.

(1) A hard glass beaker having a capacity of 500 ml was charged with 10 g, precisely measured to the unit of 0.1 mg, of a sample, and pure water was first added little by little to the sample of wet the sample sufficiently and then, pure water was further added so that the total amount of added pure water was 250 ml. The total weight was measured.

(2) The charge in the flask was boiled for 10 minutes and then cooled to room temperature. The entire weight was measured, and pure water was added in an amount corresponding to the amount lost.

(3) The charge was sufficiently stirred and filtered by using filter paper No. 2 (supplied by Toyo Roshi). Initial about 500 ml of the filtrate was discarded, and the remainder of the filtrate was collected.

(4) A round evaporating dish (having a diameter of 90 mm) having a known weight was charged with 50 ml of the filtrate and the filtrate was subjected to evaporation to dryness on a sand bath so that a very slight amount of water was left. Then, another 50 ml of the filtrate was added and was subjected to evaporation to dryness in the same manner as described above.

(5) The evaporation residue was dried for 2 hours in a drier maintained at 105° to 110° C.

(6) The dried residue was charged in a desiccator and naturally cooled for 20 minutes, and the weight of the evaporation residue was measured to the unit of 0.1 mg.

(7) The water-soluble component content M (%) was calculated according to the following equation:

$$M=[(N\times 25)/S]\times 100$$

wherein N stands for the amount (g) of the evaporation residue, and S stands for the weight (g) of the sample.

The calculation was made down to the fourth decimal place and the obtained value was rounded to three decimal places.

REFERENTIAL EXAMPLE

Water-soluble component contents of magnetite samples A, B, C and D were measured, and water contents were measured at various relative humidities at 20° C. The obtained results are shown in Table 1.

TABLE 1

| Magnetite Sample | Water-Soluble Component Content (% by weight) | Water Content (% by weight) Relative Humidity at 20° C. 0% | 55% | 85% | 100% |
|---|---|---|---|---|---|
| A | 0.05 | 0.09 | 0.15 | 0.15 | 0.45 |
| B | 0.10 | 0.06 | 0.10 | 0.21 | 0.49 |
| C | 0.15 | 0.05 | 0.13 | 0.45 | 0.65 |
| D | 0.25 | 0.12 | 0.34 | 0.57 | 0.71 |

EXAMPLE 1

Magnetite (sample A): 52 parts by weight
Himer SBM-73 (styrene resin supplied by Sanyo Kasei Kogyo K.K.): 40 parts by weight
Viscol 550-P (low-molecular-weight polypropylene supplied by Sanyo Kasei Kogyo K.K.): 8 parts by weight A mixture having the above-mentioned composition was sufficiently melt-kneaded and dispersed by a hot three-roll mill, and the mixture was taken out, cooled and roughly pulverized to about 2 mm by a rough pulverizer (Rotoplex Cutting Mill supplied by Alpine Co.). Then, the mixture was finely pulverized by an ultra-high speed jet mill (supplied Nippon Pneumatic MFG. Co., Ltd.) to obtain a toner having a particle size of 10 to 20μ. In order to impart a flowability to the obtained toner, 0.5% of silica (R-972 supplied by Nippon Aerosil Co.) was sprinkled on the toner. The toner was charged in a copying machine (Model MC-20 supplied by Mita Industrial Co., Ltd.; the pressure roll fixing system was changed to a hot roller fixing system), and the copying operation was carried out in an atmosphere of a relative humidity of 20%, 60% or 85% at 20° C. In each case, a clear copy with no fogging was obtained.

The image densities of the copies obtained at the respective relative humidities were measured to obtain results shown in Table 2.

EXAMPLE 2

Magnetite (sample B): 52 parts by weight
Himer SBM-73: 40 parts by weight
Viscol 550-P: 8 parts by weight A toner having a particle size of 10 to 20μ was prepared from a mixture having the above-mentioned composition in the same manner as described in Example 1. The obtained toner was sprinkled with 0.5% of silica (R-972) and was charged in a copying machine MC-20 (the pressure roller fixing system was changed to the hot roller fixing system). The copying operation was carried out in the same atmosphere as described in Example 1. A clear copy with no fogging was obtained. The image density of the obtained copy is shown in Table 2.

EXAMPLE 3

Magnetite (sample C): 52 parts by weight
Himer SBM-73: 40 parts by weight
Viscol 550-P: 8 parts by weight A toner having a particle size of 10 to 20μ was prepared from a mixture having the above-mentioned composition in the same manner as described in Example 1. The obtained toner was sprinkled with 0.5% of silica (R-972) and was charged in a copying machine MC-20 (the pressure roll fixing system was changed to a hot roller fixing system). The copying operation was carried out in the same atmosphere as described in Example 1. In atmospheres of relative humidities of 20 and 60%, clear copies with no fogging were obtained, but in the atmosphere of a relative humidity of 85%, the image was coarsened and the image density was not sufficient.

The image densities of the copies obtained at the respective relative humidities are shown in Table 2.

EXAMPLE 4

Magnetite (sample A): 70 parts by weight
San-Wax 165-P (low-molecular-weight polyethylene was supplied by Sanyo Kasei Kogyo K.K.): 15 parts by weight
Versamid 940 (polyamide resin supplied by Henckel Japan K.K.): 11 parts by weight
Printex L (carbon black supplied by Degusa Co.): 4 parts by weight A toner having a particle size of 10 to 20μ was prepared from a mixture having the above-mentioned composition in the same manner as described in Example 1. The obtained toner was sprinkled with 0.5% of carbon black (Printex L) and was charged in a copying machine (Mita Copystar 900D supplied by Mita Industrial Co., Ltd.). The copying operation was carried out on a zinc oxide photosensitive sheet in the same atmosphere as described in Example 1. A clear copy with no fogging was obtained. The image density of the obtained copy is shown in Table 2.

COMPARATIVE EXAMPLE 1

Magnetite (sample D): 52 parts by weight
Himer SBM-73: 40 parts by weight
Viscol 550-P: 8 parts by weight A toner having a particle size of 10 to 20μ was prepared from a mixture having the above-mentioned composition in the same manner as described in Example 1. The obtained toner was sprinkled with 0.5% of silica (R-972) and charged in a copying machine MC-20 (the pressure roll fixing system was changed to a hot roller fixing system). The copying operation was carried out in the same atmosphere as described in Example 1. At a relative humidity of 20%, a copy with no fogging was obtained, but at a relative humidity of 60% or 85%, the image was coarsened and a sufficient image density was not obtained.

The image densities of the obtained copies are shown in Table 2.

COMPARATIVE EXAMPLE 2

Magnetite (sample D): 70 parts by weight
San-Wax 165-P: 15 parts by weight
Versamid 940: 11 parts by weight
Printex L: 4 parts by weight A toner having a particle size of 10 to 20μ was prepared from a mixture having the above-mentioned composition in the same manner as described in Example 1. The obtained toner was sprinkled with 0.5% of carbon black (Printex L) and charged in a copying machine (Mita Copystar 900D). The copying operation was carried out on a zinc oxide photosensitive sheet in the same atmosphere as described in Example 1. At a relative humidity of 20% or 60%, a copy with no fogging was obtained, but at a relative humidity of 85%, fogging was caused and the obtained copy could not be put into practical use.

The image densities of the copies obtained at the respective relative humidities are shown in Table 2.

TABLE 2

| | Image Density Relative Humidity at 20° C. | | |
|---|---|---|---|
| | 20% | 60% | 85% |
| Example 1 | 1.595 | 1.575 | 1.525 |
| Example 2 | 1.580 | 1.580 | 1.480 |
| Example 3 | 1.532 | 1.393 | 0.870 |
| Example 4 | 1.573 (0.007) | 1.577 (0.005) | 1.580 (0.009) |
| Comparative Example 1 | 1.240 | 0.859 | 0.329 |
| Comparative Example 2 | 1.555 (0.009) | 1.558 (0.011) | 1.560 (0.029) |

Note
Each parenthesized value indicates the fog density.

From the foregoing results, it will readily be understood that in case of the insulating toners (Examples 1 through 3 and Comparative Example 1), the lower is the water-soluble component content in magnetite, the more stabilized is the image density irrespectively of the relative humidity in the atmosphere, and that in case of the electroconductive toners (Example 4 and Comparative Example 2), a clear image with no fogging can be obtained according to the present invention irrespectively of the relative humidity in the atmosphere.

What is claimed is:

1. A magnetic toner having an improved humidity dependency, which comprises as main ingredients a magnetic material composed of magnetite and a binder medium, wherein the water-soluble component content in the magnetite is lower than 0.1% by weight and the water content of the magnetite at a temperature of 20° C. and a relative humidity of 60% is lower than 0.3% by weight.

2. A magnetic toner as set forth in claim 1, wherein the particle size of the magnetite is 0.05 to 10 μm.

3. A magnetic toner as set forth in claim 1, wherein the particle size or the toner is 5 to 50 μm.

4. A magnetic toner as set forth in claim 1, wherein the binder medium is a homopolymer or copolymer of a vinyl aromatic monomer or an acrylic monomer.

5. An electroconductive magnetic toner as set forth in claim 1, wherein the weight ratio of the magnetite to the binder medium is in the range of from 0.5/1 to 5/1.

6. An insulating magnetic toner as set forth in claim 1, wherein the weight ratio of the magnetite to the binder medium is in the range of from 1/4 to 4/1.

7. An electroconductive magnetic toner as set forth in claim 5, wherein an electroconductive substance is incorporated in an amount of 0.1 to 10% by weight based on the sum of the magnetite and the binder medium.

* * * * *